United States Patent [19]

Hoekstra et al.

[11] Patent Number: 4,532,991

[45] Date of Patent: Aug. 6, 1985

[54] PULSED RETORTING WITH CONTINUOUS SHALE OIL UPGRADING

[75] Inventors: George R. Hoekstra, Wheaton; John M. Forgac, Elmhurst, both of Ill.

[73] Assignee: Standard Oil Company (Indiana), Chicago, Ill.

[21] Appl. No.: 592,375

[22] Filed: Mar. 22, 1984

[51] Int. Cl.[3] ..... E21B 43/24

[52] U.S. Cl. ..... 166/261; 166/259; 166/266

[58] Field of Search ..... 166/259, 256, 260, 261, 166/266, 267, 299; 208/11 R

[56] References Cited

U.S. PATENT DOCUMENTS

| | | | |
|---|---|---|---|
| 4,036,299 | 7/1977 | Cha et al. | 166/261 |
| 4,192,381 | 3/1980 | Cha | 299/2 X |
| 4,353,418 | 10/1982 | Hoekstra et al. | 166/267 X |
| 4,436,344 | 3/1984 | Forgac et al. | 166/259 |
| 4,444,256 | 4/1984 | Shen | 166/259 |
| 4,457,374 | 7/1984 | Hoekstra et al. | 166/251 X |

*Primary Examiner*—Stephen J. Novosad
*Assistant Examiner*—Bruce M. Kisliuk
*Attorney, Agent, or Firm*—Thomas W. Tolpin; William H. Magidson; William T. McClain

[57] ABSTRACT

One or more in situ oil shale retorts are alternately operated in a combustion mode and a purge mode with a steam or water purge to produce a greater yield of shale oil. Hydrogen-rich off gases emitted during purging are mixed with the shale oil in a reactor in the presence of a catalyst, after being stripped of carbon dioxide, to produce a high quality shale oil. The reactor off gases, purge mode off gases, and/or hydrogen gases can also be used as the purge gas.

15 Claims, 3 Drawing Figures

CO2 SCRUBBER
CO2
CATALYST
UPGRADING REACTOR
SHALE OIL
SYNCRUDE
GASES
FEED
FUEL GAS
PURGE
GROUND LEVEL
BURNERS
SPENT SHALE
COMBUSTION ZONE
FLAME FRONT
RETORTED SHALE
RETORTING ZONE
OIL
WATER

CATALYST
SHALE OIL
CRYOGENIC PROCESSOR
UPGRADING REACTOR
FEED
FUEL GAS
PURGE
SYNCRUDE
GASES
WATER
RECIRCULATED WATER
GROUND LEVEL
BURNERS
SPENT SHALE
COMBUSTION ZONE
FLAME FRONT
RETORTED SHALE
RETORTING ZONE
OIL
WATER

PULSED RETORTING WITH CONTINUOUS SHALE OIL UPGRADING

BACKGROUND OF THE INVENTION

This invention relates to a process for underground retorting of oil shale and upgrading of shale oil.

Researchers have now renewed their efforts to find alternate sources of energy and hydrocarbons in view of past rapid increases in the price of crude oil and natural gas. Much research has been focused on recovering hydrocarbons from solid hydrocarbon-containing material such as oil shale, coal and tar sands by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts or in underground in situ retorts. In situ retorts require less mining and handling than surface retorts.

In vertical in situ retorts, a flame front moves downward through a rubblized bed containing rich and lean oil shale to liberate shale oil, off gases and condensed water. There are two types of in situ retorts: true in situ retorts and modified in situ retorts. In true in situ retorts, none of the shale is mined, holes are drilled into the formation and the oil shale is explosively rubblized, if necessary, and then retorted. In modified in situ retorts, some of the oil shale is removed by mining to create a cavity which provides extra space for explosively rubblized oil shale. The oil shale which has been removed is conveyed to the surface and retorted above ground.

In order to obtain high thermal efficiency in retorting, carbonate decomposition should be minimized. Colorado Mahogany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones. The choice of a particular retorting method must therefore take into consideration carbonate decomposition as well as raw and spent materials handling expense, product yield and process requirements.

While efforts are made to explosively rubblize the oil shale into uniform pieces, in reality the rubblized mass of oil shale contains numerous different sized fragments of oil shale which create vertical, horizontal and irregular channels extending sporadically throughout the bed and along the wall of the retort. As a result, during retorting, hot gases often flow down these channels and bypass large portions of the bed, leaving significant portions of the rubblized shale unretorted.

Different sized oil shale fragments, channeling and irregular packing, and imperfect distribution of oil shale fragments cause other deleterious effects including tilted (nonhorizontal) and irregular flame fronts in close proximity to the retorting zone and fingering, that is, flame front projections which extend downward into the raw oil shale and advance far ahead of other portions of the flame front. Irregular flame fronts and fingering can cause coking, burning, and thermal cracking of the liberated shale oil. Irregular, tilted flame fronts can lead to flame front breakthrough and incomplete retorting. In the case of severe channeling, horizontal pathways may permit oxygen to flow underneath the raw unretorted shale. If this happens, shale oil flowing downward in that zone may burn. It has been estimated that losses from burning in in situ retorting can be as high as 40% of the product shale oil.

Furthermore, during retorting, significant quantities of oil shale retort water are also produced. Oil shale retort water is laden with suspended and dissolved impurities, such as shale oil and oil shale particulates ranging in size from less than 1 micron to 1,000 microns and contain a variety of other contaminants not normally found in natural petroleum (crude oil) refinery waste water, chemical plant waste water or sewage. Oil shale retort water usually contains a much higher concentration of organic matter and other pollutants than other waste waters or sewage causing difficult disposal and purification problems.

The quantity of pollutants in water is often determined by measuring the amount of dissolved oxygen required to biologically decompose the waste organic matter in the polluted water. This measurement, called biochemical oxygen demand (BOD), provides an index of the organic pollution in the water. Many organic contaminants in oil shale retort water are not amenable to conventional biological decomposition. Therefore, tests such as chemical oxygen demand (COD) and total organic carbon (TOC) are employed to more accurately measure the quantity of pollutants in retort water. Chemical oxygen demand measures the amount of chemical oxygen needed to oxidize or burn the organic matter in waste water. Total organic carbon measures the amount of organic carbon in waste water.

Over the years, a variety of methods have been suggested for purifying or otherwise processing oil shale retort water. Such methods have included shale adsorption, in situ recycling, electrolysis, flocculation, bacteria treatment and mineral recovery. Typifying such methods and methods for treating waste water from refineries and chemical and sewage plants are those described in U.S. Pat. Nos. 2,948,677; 3,589,997, 3,663,435; 3,904,518; 4,043,881; 4,066,538; 4,069,148; 4,073,722; 4,124,501; 4,178,039; 4,121,662; 4,207,179; and 4,289,578. Typifying the many methods of in situ retorting are those found in U.S. Pat. Nos. 1,913,395; 1,191,636; 2,418,051; 3,001,776; 3,586,377; 3,434,757; 3,661,423; 3,951,456; 3,980,339; 3,994,343; 4,007,963; 4,017,119; 4,105,251; 4,120,355; 4,126,180; 4,133,380; 4,149,752; 4,153,300; 4,158,467; 4,117,886; 4,185,871; 4,194,788; 4,199,026; 4,210,867; 4,210,868; 4,231,617; 4,243,100; 4,263,969; 4,263,970; 4,265,486; 4,266,608; 4,271,904; 4,315,656; 4,323,120; 4,323,121; 4,328,863; 4,343,360; 4,343,361; 4,353,418; 4,378,949; 4,425,967; and 4,436,344. These prior art processes have met with varying degrees of success.

It is, therefore, desirable to provide an improved in situ oil shale retort and process which overcome most, if not all, of the above problems.

SUMMARY OF THE INVENTION

An improved in situ retorting process is provided to produce and upgrade shale oil. In the novel process, one or more underground oil shale retorts are sequentially or alternately operated in a combustion mode and a purge mode with a steam or water quench to provide a substantially continuous supply of hydrogen-rich, purge mode off gases to a hydrotreater or other upgrading reactor for continuous shale oil upgrading. Desirably, the hydrogen-rich off gases are purged of carbon dioxide and/or other contaminants in a scrubber, cryogenic processor, stripper, or other gas treater or purifier before being fed to the upgrading reactor. In the preferred form, some of the underground retorts are operated in a combustion mode while the other underground retorts are operated in a purge mode and vice versa for greater process efficiency and effectiveness.

During the combustion mode, the flame front is ignited and driven through the retort with a flame-front supporting feed gas. During the purge mode, the flame front is intermittently stopped by replacing the feed gas with a purge fluid (quench) to extinguish the flame front while continuously retorting the oil shale. This alternate extinguishment and ignition of the flame front is referred to as "pulsed combustion."

The purge (quench) preferably consists essentially of steam or water purge. The water purge can be purified water, condensed steam, or recycled retort water from an underground or aboveground retort. Retort water typically contains oil shale particulates, shale oil, ammonia, and organic carbon. The purge can also be hydrogen or hydrogen-rich gases.

The flame front-supporting feed gas can be air or an oxidizing gas diluted with steam, water, retort off gases, reactor off gases, or combinations thereof.

Pulsed combustion promotes uniformity of the flame front and minimizes fingering and projections of excessively high temperature zones in the rubblized beds of shale. When the combustion-sustaining feed gas is shut off, combustion stops and burning of product oil is quenched and the area in which the flame front was present remains stationary during shut off to distribute heat downward in that bed. Upon reignition, a generally horizontal flame front is established which advances in the general direction of flow of the feed gas. Intermittent injection of feed gas lowers the temperature of the flame front, minimizes carbonate decomposition, coking and thermal cracking of liberated hydrocarbons. The pulse rate and duration of the feed gas control the profile of the flame front.

During purging, heat is dissipated throughout the bed where retorting was incomplete or missed and these regions are retorted to increase product recovery. Thermal irregularities in the bed equilibrate between pulses to lower the maximum temperature in the retort.

During periods of noncombustion, sensible heat from the retorted and combusted shale advances downward through the raw colder shale to heat and continue retorting the beds. Continuous retorting between pulses, advances the leading edge (front) of the retorting zones and thickens the layers of retorted shale containing unburned, residual carbon to enlarge the separation between the combustion and retorting zones when the flame front is reignited in response to injection of the next pulse of feed gas. Greater separation between the combustion and retorting zones decreases flame front breakthrough, oil fires and gas explosions.

During feed gas shutoff, the liberated shale oil has more time to flow downward and liquefy on the colder raw shale. Drainage and evacuation of oil during noncombustion moves the effluent oil farther away from the combustion zone upon reignition to provide an additional margin of safety which diminishes the chances of oil fires. Additional benefits of pulsed combustion include the ability to more precisely detect the location and configuration of the flame front and retorting zone by monitoring the change of off gas composition.

As used in this application, the term "shale oil" means oil which has been obtained from retorting raw oil shale.

The term "retorted oil shale" means raw oil shale which has been retorted to liberate shale oil, light hydrocarbon gases and retort water, leaving an inorganic material containing residual carbon.

The terms "spent oil shale" and "combusted oil shale" as used herein mean retorted oil shale from which most of the residual carbon has been removed by combustion.

The terms "oil shale water," "shale water," and "retort water" mean water which have been emitted during retorting of raw oil shale.

The term "oil shale particulates" as used herein includes particulates of raw, retorted and combusted oil shale ranging in size from less than 1 micron to 1,000 microns.

The terms "normally liquid," "normally gaseous," "condensible," "condensed," and "noncondensible" as used throughout this application are relative to the condition of the subject material at a temperature of 77° F. (25° C.) at atmospheric pressure.

A more detailed explanation of the invention is provided in the following description and appended claims taken in conjunction with the accompanying drawing.

DETAILED DESCRIPTION OF THE PREFERRED EMBODIMENTS

A series or set of underground, modified in situ oil shale retorts 10*a*, 10*b*, 10*c*, and 10*d* (FIG. 1) are arranged in a tier or array in adjacent subterranean formations 12 of oil shale to produce shale oil and hydrocarbon gases from raw oil shale. There are at least two retorts and preferably four or more retorts. For commercial production, there are at least 30 retorts.

Figure 2:
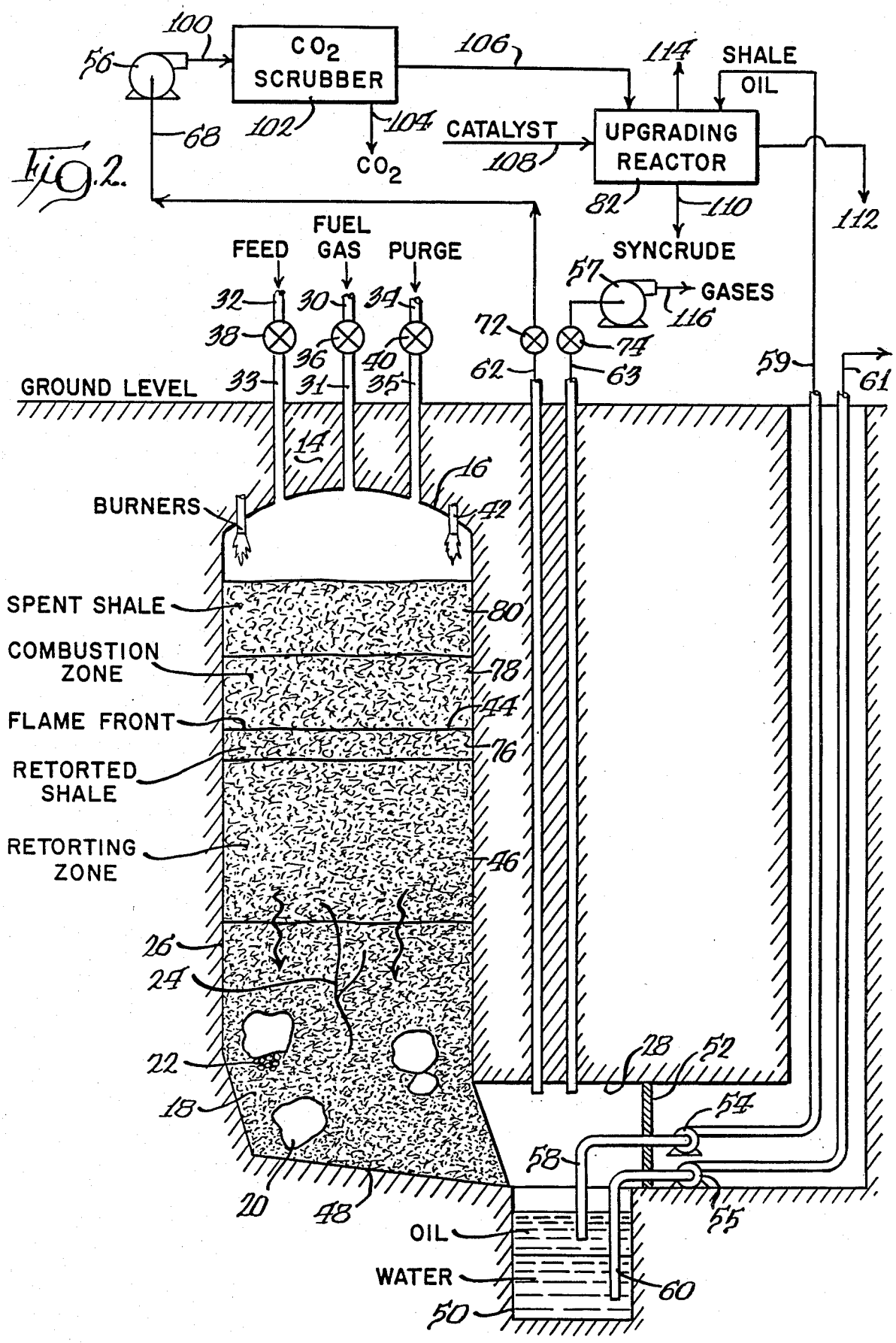
FIG. 2 is a schematic flow diagram of one of the in situ retorts.

As best shown in FIG. 2, each retort is covered with an overburden 14 and is elongated, upright, and generally box-shaped, with a top or dome-shaped roof 16. Each retort is filled with an irregularly packed, fluid permeable, rubblized mass or bed 18 of different sized oil shale fragments including large oil shale boulders 20 and minute oil shale particles or fines 22. Irregular, horizontal and vertical channels 24 extend throughout the bed and along the walls 26 of each retort.

The rubblized mass is formed by first mining an access tunnel or drift 28 extending horizontally into the bottom of each retort and removing from 2% to 40% and preferably from 15% to 25% by volume of the oil shale from a central region of the retort to form a cavity or void space. The removed oil shale is conveyed to the surface and retorted in one or more aboveground retorts. The mass of oil shale surrounding the cavity is then fragmented and expanded by detonation of explosives to form the rubblized mass 18.

Conduits or pipes 30–35 extend from above ground through overburden 14 into the top of the retorts. The pipes include ignition fuel lines 30 and 31, feed lines 32 and 33, and purge lines 34 and 35. The extent and rate of gas flow through the fuel, feed, and purge lines are regulated and controlled by valves 36, 38, and 40, respectively. Burners 42 are located in proximity to the top of the shale beds.

In order to commence retorting or pyrolyzing of the rubblized mass 18 of oil shale, a liquid or gaseous fuel, preferably a combustible ignition gas or fuel gas, such as recycled off gases or natural gas, is fed into the retort through the fuel lines 30 and 31 and an oxygencontaining, flame front-supporting, feed gas or fluid, such as air, is fed into the retort through the feed lines 32 and 33. The burners are then ignited to establish a flame front 44 horizontally across the bed 18. If economically feasible or otherwise desirable, the rubblized mass of oil shale can be preheated to a temperature slightly below the retorting temperature with an inert preheating gas, such as steam, nitrogen, or retort off gases, before introduction of feed fluid and ignition of the flame front. After ignition, the fuel valve is closed to shut off inflow of fuel gas. Once the flame front is established, residual carbon contained in the oil shale usually provides an adequate source of fuel to maintain the flame front as long as the oxygen-containing feed gas is supplied to the flame front. Fuel gas or shale oil can be fed into the retort through the fuel line to augment the feed gas for leaner grades and seams of oil shale.

The oxygen-containing feed sustains and drives the flame front downwardly through the bed of oil shale. The feed can be air, or air enriched with oxygen, or air diluted with a diluent. The diluent can be steam, recycled retort off gases, purified (treated) water, condensed steam, or raw oil shale retort water containing oil shale particulates, shale oil, ammonia, and organic carbon, or combinations thereof, as long as the feed gas has from 5% to less than 90% and preferably from 10% to 30% and most preferably a miximum of 20% by volume molecular oxygen. The oxygen content of the feed gas can be varied throughout the process.

The flame front emits combustion off gases and generates heat which moves downwardly ahead of the flame front and heats the raw, unretorted oil shale in a retorting zone 46 to a retorting temperature from 800° F. to 1200° F. to retort and pyrolyze the oil shale in the retorting zone. During retorting, oil shale retort water and hydrocarbons are liberated from the raw oil shale. The hydrocarbons are liberated as a gas, vapor, mist or liquid droplets and most likely a mixture thereof. The liberated hydrocarbons include light gases, such as methane, ethane, ethene, propane, and propene, and normally liquid shale oil which flows downwardly by gravity, condense and liquefy upon the cooler, unretorted raw shale below the retorting zone, forming condensates which percolate downwardly through the retort into access tunnel 28.

Retort off gases emitted during retorting include various amounts of hydrogen, carbon monoxide, carbon dioxide, ammonia, hydrogen sulfide, carbonyl sulfide, oxides of sulfur and nitrogen, water vapors, and low molecular weight hydrocarbons. The composition of the off gas is dependent on the composition of the feed.

Oil shale retort water is formed from the thermal decomposition of kerogen during retorting and is referred to as "water of formation." Oil shale retort water can also be derived from in situ steam injection (process water), aquifers or natural underground streams in in situ retorts (aquifer water), and in situ shale combustion (water of combustion).

Raw retort oil shale water, if left untreated, is generally unsuitable for safe discharge into lakes and rivers or for use in downstream shale oil processes, because it contains a variety of suspended and dissolved pollutants, impurities and contaminants, such as raw, retorted and spent oil shale particulates, shale oil, grease, ammonia, phenols, sulfur, cyanide, lead, mercury and arsenic. Oil shale water is much more difficult to process and purify than waste water from natural petroleum refineries, chemical plants and sewage treatment plants, because oil shale water generally contains a much greater concentration of suspended and dissolved pollutants which are only partially biodegradable. For example, untreated retort water contains over 10 times the amount of total organic carbon and chemical oxygen demand, over 5 times the amount of phenol and over 200 times the amount of ammonia as waste water from natural petroleum refineries.

Oil shale retort water is laden with suspended and dissolved impurities including shale oil and particulates of raw, retorted and/or spent oil shale ranging in size from less than 1 micron to 1,000 microns as well as a variety of other impurities as explained below. The amount and proportion of the shale oil, oil shale particulates and other impurities depend upon the richness and composition of the oil shale being retorted, the composition of the feed gas and retorting conditions. One sample of retort water from a modified in situ retort had a pH of 8.9 to 9.1 and an alkalinity of 12,000 mg/l, and contained 1,800 mg/l total organic carbon, 7,000 mg/l chemical oxygen demand, 15,000 mg/l total solids, 1,600 mg/l ammonia, 6,000 mg/l sodium, 7 mg/l magnesium and 5 mg/l calcium.

Three other test samples of oil shale retort water from a modified, in situ retort had the following composition:

| | Test 1 | Test 2 | Test 3 |
|---|---|---|---|
| COD, mg/l | 11174 | 13862 | 10140 |
| Phenols, mg/l | 29 | 30 | 30 |
| Total dissolved solids, mg/l | 3159 | 2151 | 1099 |
| Total suspended solids, mg/l | 718 | 435 | 10.8 |
| Organic C, ppm | 6660 | 5640 | 4220 |
| Inorganic C, ppm | 1520 | 1600 | 4120 |
| $NH_3$, ppm | 1150 | 6000 | 690 |
| Cu, ppm | <0.05 | <0.05 | <0.05 |
| F—, ppm | 2 | 3 | 1 |
| N, ppm | 5200 | 4700 | 6970 |
| Ni, ppm | 0.38 | 0.53 | 0.30 |
| P, ppm | 3 | <1 | 852 |
| S, % | 0.05 | 0.05 | 0.04 |
| Zn, ppm | 0.05 | 0.08 | 0.08 |
| CN—, ppm | <.01 | <.01 | 0.41 |
| Ag, ppm | <0.05 | <0.05 | <0.05 |
| As, ppm | 1.06 | 0.47 | 0.5 |

Another test sample of oil shale retort water from a modified in situ retort had the following composition:

| | |
|---|---|
| $HCO_3$ | 668 mg/l |
| SCOD | 1249 mg/l |
| TOTAL ALKALINITY | 1164 mg/l |
| N (TOTAL) | 540 mg/l |
| $NH_3$ | 392 mg/l |
| $NO_3$ | .41 mg/l |
| F | 1.29 mg/l |
| S | 53.0 mg/l |
| TOC | 281 mg/l |
| PHENOL | 14.2 mg/l |
| Shale oil and grease | 106 mg/l |
| As | .133 mg/l |
| B | .23 mg/l |
| $SO_4$ | 1916 mg/l |
| $S_2O_3$ | 426 mg/l |
| SCN | 0.17 mg/l |
| CN | <.05 mg/l |
| pH | 8.7 |
| ORGANIC-N | 80.8 mg/l |
| TRACE ELEMENTS | |
| Ba | <.1 mg/l |
| Cd | <.01 mg/l |
| Cr | <.01 mg/l |
| Cu | <.01 mg/l |
| Pb | <.05 mg/l |
| Hg | <.0003 mg/l |
| Mo | 0.9 mg/l |
| Sc | <.05 mg/l |
| Ag | <.01 mg/l |
| Zn | <.01 mg/l |

The effluent product stream of condensate (liquid shale oil and shale oil retort water) and off gases in each retort, flow downward to the sloped bottom 48 (FIG. 2) of the retort and then into its own collection basin and separator 50, also referred to as a "sump" in the bottom of the access tunnel. A concrete wall 52 prevents leakage of off gas into the mine.

Liquid shale oil, water, purge mode off gases, and combustion mode off gases are separated in the collection basins by gravity and pumped to the surface by pumps 54–57, respectively, through inlet and return lines 58–63, respectively. The pumps can be located above ground or below ground, as desired.

Figure 1:
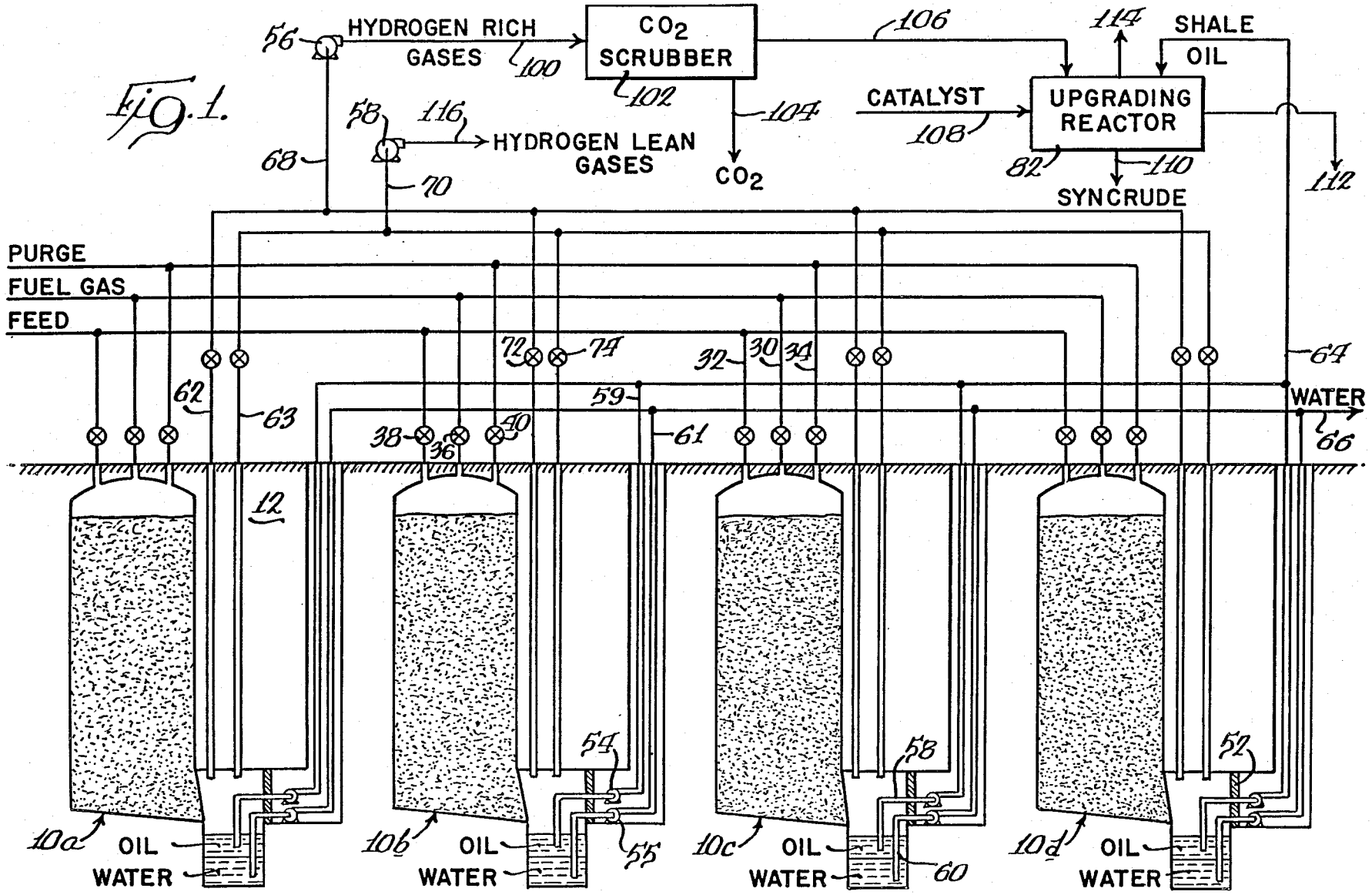
FIG. 1 is a schematic cross-sectional view of a continuous upgrading and pulsed in situ retorting process in accordance with principles of the present invention.

As best shown in FIG. 1, shale oil from the retorts are combined and mixed in a single common oil line 64. Retort water from the retorts are combined and mixed in a common water line 66. Hydrogen rich purge mode off gases from the retorts are combined and mixed in a single, common purge gas line 68. Hydrogen lean combustion mode off gases from the retorts are combined and mixed in a single, common combustion gas line 70.

In each retort, a purge valve 72 controls the flow of purge mode off gases. A combustion gas valve 74 controls the flow of combustion mode off gases. While separate purge mode and combustion mode gas lines are preferred for best results, it may be desirable in some circumstances to use, in lieu thereof, a common, single, purge mode and combustion mode gas line with a single control valve to selectively direct the flow of off gases to either the common purge gas line or the common combustion gas line depending on whether the retort is in a purge mode or in a combustion mode. Additional valves can be used, if desired, to control the flow of shale oil and retort water.

Raw (untreated) retort combustion mode off gases can be recycled as part of the fuel gas or feed, either directly or after light gases and oil vapors contained therein have been stripped away in a quench tower or stripping vessel.

During the retorting process, retorting zone 46 (FIG. 2) moves downward leaving a layer or band 76 of retorted shale with residual carbon. Retorted shale layer 76 above retorting zone 46 defines a retorted shale zone which is located between retorting zone 46 and the flame front 44 of the combustion zone 78. Residual carbon in the retorted shale is combusted in the combustion zone 78 leaving spent, combusted shale in a spent shale zone 80.

In order to enhance more uniform flame fronts across the retorts, the feed gas in the feed lines are fed into the retorts in pulses by intermittently stopping the influx of feed fluid via the feed gas control valves to alternately quench and reignite the flame fronts for selected intervals of time. A purging gas or fluid, also referred to as a purge gas or fluid, "purge," or "quench," is injected or sprayed downwardly through the purge lines into the combustion zones of the retorts in which the inflow of feed gas has been stopped between pulses of feed. The purge extinguishes, quenches, and blankets the flame front and accelerates transfer of sensible heat from the combustion zone to the retorting zone of the retort.

When the flame front of a retort is purged (extinguished) between pulses of feed fluid, that retort is operated in a purging or purge mode of operation. When the flame front of a retort is present and supported by a feed gas, that retort is operated in a combustion mode of operation.

In order to provide a substantially continuous supply of hydrogen-enriched purging-mode off gases to one or more upgrading reactors 82 for continuous shale oil upgrading operation and in order to enhance process efficiency, economics, and product recovery, some of the retorts are operated in the combustion mode while the other retorts are operated in the purging mode and vice versa. This sequential pulsing process also provides a substantially continuous supply of combustion and purge mode off gases for use as part of the feed gas. During the combustion mode of a retort, the retort's feed and combustion off gas valves are open, while the retort's purge and purge mode off gas valves are closed. During the purge mode of operation of a retort, the retort's purge and purge mode off gas valves are open, while the retort's feed gas valves are closed.

In the preferred embodiment, alternate (every other) retorts, retorts 10*a* and 10*c* (FIG. 1) are operated in the combustion mode while the other retorts 10*b* and 10*d* are operated in the purging mode and vice versa. Retorts 10*a* and 10*c*, therefore, operate together in tandem in the same phase and interval. Retorts 10*b* and 10*d* also operate together in tandem in the same phase and interval but in an opposite phase and interval to retorts 10*a* and 10*c*.

If desired, adjacent retorts 10*a* and 10*b* can be operated in the same phase and interval in the combustion mode, while adjacent retorts 10*c* and 10*d* are in the opposite phase and interval in the purging mode and vice versa. Also, retorts 10*a* and 10*d* can be operated in the same phase and interval, if desired, while retorts 10*b* and 10*c* are operated in another phase.

Furthermore, if desired, one of the retorts can be in one phase and interval while the other retorts are in an opposite phase and interval. It will be appreciated that other phase combinations, intervals, and sequences can also be used, if desired.

Figure 3:
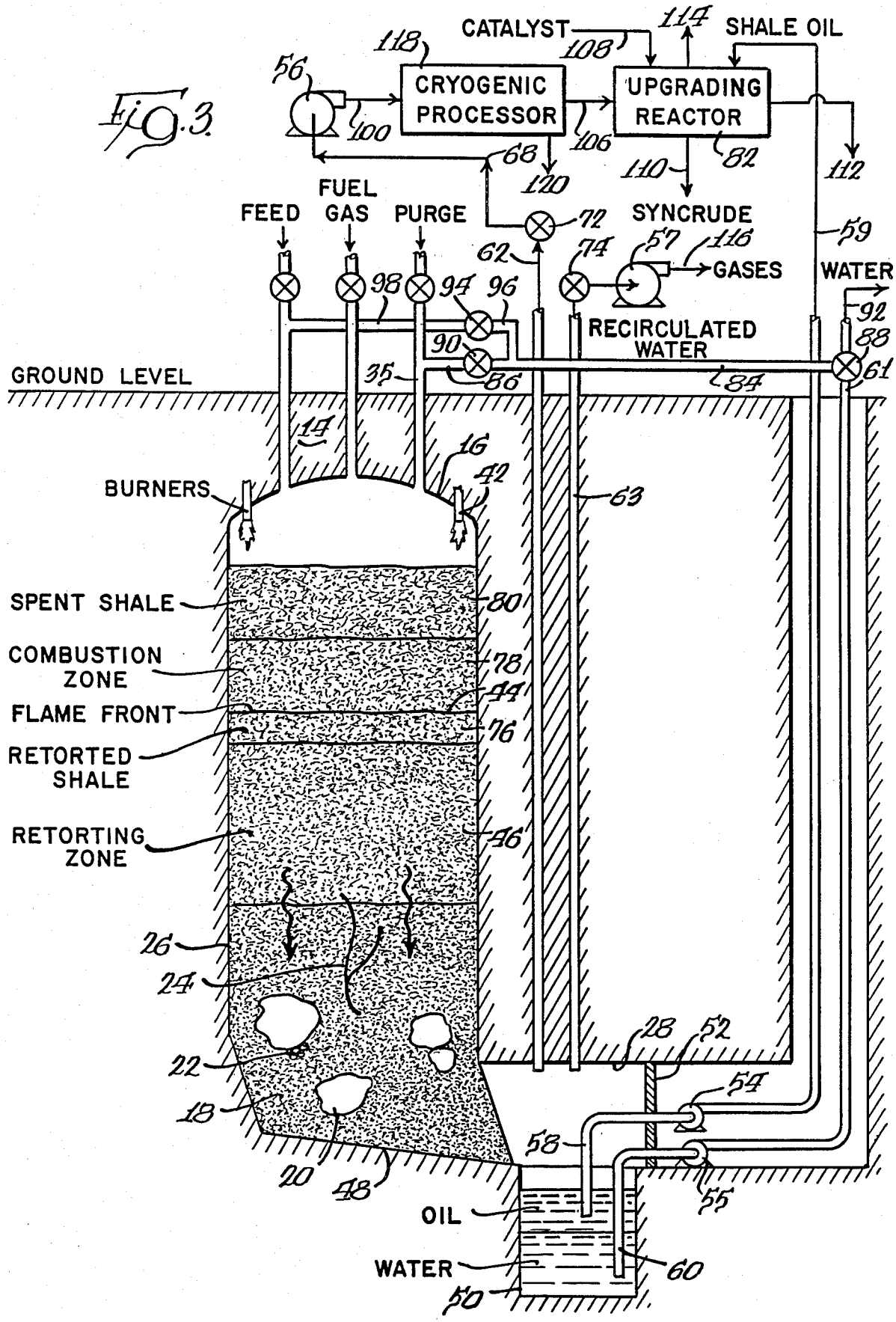
FIG. 3 is an alternate schematic flow diagram of one of the in situ retorts with retort oil shale water used as the purge and a cryogenic processor.

As shown in FIG. 3, the purge fluid can consist of or comprise raw (untreated) retort shale water containing oil shale particulates, shale oil, organic carbon, and ammonia, which has been fed (recycled) to the purge lines of the retorts by the retort water lines 61, 84, and 86 via retort water valves 88 and 90. This avoids the enormous expense of purifying and treating the contaminated retort water to environmentally acceptable levels and thereby enhances retorting efficiency and economy. Excess retort water can be discharged for purification, treatment, and/or further processing through water discharge line 92 via two-way valve 88, after closing valves 90 and 94.

The purge fluid can also contain or consist of purified (treated) water, condensed steam, uncondensed steam, nitrogen, carbon dioxide, hydrogen, purge mode off gases, combustion mode off gases, or reactor off gases. Retort water from an aboveground retort can also be used as the purge. Uncondensed steam is particularly useful as a purge gas.

Raw (untreated) retort water containing oil shale particulates, oil shale, organic carbon and ammonia can also be fed (recycled) to the feed lines of the retorts by lines 61, 84, 96, and 98, upon opening valves 86 and 88, for use as part of the feed for even greater retorting economy and efficiency. Retort water from an aboveground retort can also be fed into the feed lines for use as part of the feed.

During purging, i.e., between pulses of feed, retorting of oil shale continues. The purge fluid ehances the rate of downward advancement of retorting zone to widen the gap and separation between the leading edge or front of retorting zone and the combustion zone. Purging also thickens the retorted shale layer and enlarges the separation between the retorting zone and the combustion zone. The enlarged separation minimizes losses from oil burning upon reignition which occurs when the next pulse of feed in injected. The combustion zone can be cooled to a temperture as low as 650° F. by the purge and still have successful ignition with the next pulse of feed.

The injection pressures of the feed and fuel gases, as well as the purge gas if a gas is used as the purge, is from one atmosphere to 5 atmospheres, and most preferably 2 atmospheres. The flow rates of the feed, fuel, and purge gases are a maximum of 10 SCFM/ft$^2$, preferably from 0.01 SCFM/ft$^2$ to 6 SCFM/ft$^2$, and most preferably from 1.5 SCFM/ft$^2$ to 3 SCFM/ft$^2$.

When retort water, treated water, or condensed steam is used as the purge, the injection pressure of the purge is similar to the feed, and the flow rate of the purge is from about 0.1 to 3.75 gal/hr/ft$^2$ (30 lbs/hr/ft$^2$) and most preferably a maximum of 0.275 gal/hr/ft$^2$ (2.2 lbs/hr/ft$^2$).

The duration of each pulse of feed gas and purge is from 15 minutes to 1 month, preferably from 1 hour to 24 hours and most preferably from 4 hours to 12 hours. The time ratio of purge to feed gas is from 1:10 to 10:1 and preferably from 1:5 to 1:1.

Purge mode off gases produced during purging with steam, retort water, and treated water have a substantially greater concentration of hydrogen than combustion mode off gases produced during combustion with feed gas.

Typical compositions (volume percent dry basis) of combustion mode off gases and purge mode off gases taken from a modified in situ retort with a feed gas consisting essentially of air diluted with steam and a purge gas consisting essentially of steam are shown in the following table:

| | Combustion Mode Off Gases | Purge Mode Off Gases |
|---|---|---|
| $H_2$ | 7.0 | 48.0 |
| $N_2$ | 55.4 | 1.0 |
| CO | 1.2 | 4.0 |
| $CO_2$ | 32.0 | 41.5 |
| $CH_4$ | 1.2 | 2.8 |
| $C_2H_4$ | 0.1 | 0.1 |
| $C_2H_6$ | 0.3 | 0.2 |
| $C_3H_6$ | 0.1 | 0.1 |
| $C_3H_8$ | 0.1 | 0.1 |
| $C_4$ | 0.2 | 0.1 |
| $C_5$+ | 0.2 | 0.1 |
| $O_2$ | 0.4 | 0.0 |
| $NH_3$ | 1.1 | 0.5 |
| $H_2S$ | 0.7 | 1.5 |
| COS | 0.005 | 0.008 |
| $CS_2$ | 0.002 | 0.003 |
| $CH_4S$ | 0.003 | 0.004 |

Hydrogen-rich off gases produced during purging are pumped by a purge gas pump 56 through gas lines 62, 68, and 100 to one or more $CO_2$ scrubbers 102 (FIGS. 1 and 2) where the hydrogen-rich off gases can be scrubbed of carbon dioxide. Carbon dioxide is removed from the scrubber through $CO_2$ line 104 and recycled for use as part or all of the purge gas or vented to the atmosphere. The scrubbed hydrogen-rich off gases, which contain at least 70%, preferably at least 80%, and most preferably at least 95%, by weight hydrogen, are fed through scrubbed gas line 106 to one or more upgrading reactors 82, such as hydrotreaters, hydrocrackers, or catalytic crackers, for use as an upgrading gas in upgrading the shale oil produced in the retorts.

Fresh, makeup catalyst is fed to the reactor(s) through catalyst line 108. Shale oil produced in the retorts is fed to the reactor(s) through shale oil line 59 and/or 64. The reactor(s) can be a fluid bed reactor, ebullated bed reactor, or fixed bed reactor.

In the reactor(s), the shale oil is contacted, mixed, and circulated with the upgrading gas (the scrubbed, hydrogen-rich, purge mode, off gases) in the presence of the catalyst under upgrading conditions to substantially remove nitrogen, oxygen, sulfur, and trace metals from the shale oil in order to produce an upgraded, more marketable, shale oil or syncrude. Upgraded shale oil is removed from the reactor(s) through syncrude line 110. Spent catalyst is removed from the reactor through spent catalyst line 112. Reaction off gases are removed from the reactor(s) through overhead line 114. The reaction off gases can be recycled for use as part of the fuel gas, feed gas, or purge, or can be used for other purposes.

The catalyst has at least one hydrogenating component, such as cobalt, molybdenum, nickel, or phosphorus, or combinations thereof, on a suitable support, such as alumina, silica, zeolites and/or molecular sieves having a sufficient pore size to trap the trace metals from the shale oil. Other upgrading catalysts can be used.

Typical upgrading conditions in the reactor(s) are: total pressure from 500 psia to 6000 psia, preferably from 1200 psia to 3000 psia; hydrogen partial pressure from 500 psia to 3000 psia, preferably from 1000 psia to 2000 psia; upgrading gas flow rate (off gas feed rate) from 2500 SCFB to 10,000 SCFB, and LHSV (liquid hourly space velocity) from 0.2 to 4, and preferably no greater than 2 volumes of oil per hour per volume of catalyst. Hydrotreating temperatures range from 700° F. to 830° F. Hydrocracking temperatures range from 650° F. to 820° F.

Hydrogen lean, retort off gases produced in the retorts during combustion can be pumped by combustion gas pump 58 through combustion lines 63, 70, and 116 into the fuel gas, feed, or purge lines for use as part of the fuel gas, feed, and/or purge, respectively. Alternatively, the hydrogen lean retort off gases can be fed upstream for further processing or flared for heating value.

Instead of removing carbon dioxide from the purge-mode hydrogen-rich off gases in a $CO_2$ scrubber, the purge mode off gas can be cryogenically processed in a cryogenic processing unit 118 as shown in FIG. 3 to remove the carbon dioxide and other contaminants through discharge line 120. In the cyrogenic processing unit, the purge mode off gases are condensed and cryogenically cooled in a series of cold boxes. Auto-refrigeration supplies the cooling requirements. The cryogenically processed hydrogen-rich off gases are fed through line 106 to the upgrading reactor for use as the upgrading gas. Shale oil is upgraded in the reactor in the same manner as discussed previously.

While vertical modified-in-situ retorts are used in the preferred retorting process for best results, true in situ retorts and horizontal and other shaped underground retorts can be used, if desired, to retort oil shale and produce purge mode off gases for use in upgrading the shale oil in a reactor. Furthermore, while it is preferred to commence pulsed combustion at the top of the bed of shale in the retort, in some circumstances it may be desirable to commence pulsing at other sections of the retort.

Among the many advantages of the process are:

1. Better process efficiency.
2. Continuous upgrading of shale oil.
3. More effective use of processing equipment.
4. Greater retorting economy.
5. Less purification and treatment of retort water.
6. Improved product yield and recovery.
7. Uniformity of flame front.
8. Fewer oil fires.
9. Less loss of product oil.
10. Decreased carbonate decomposition and thermal cracking of the effluent shale oil.
11. Reduced need for supplemental fuel gas, feed gas, and purge gas.
12. Lower upgrading costs.

Although embodiments of this invention have been shown and described, it is to be understood that various modifications and substitutions, as well as rearrangements and combinations of retorts, apparatus, and/or process steps, can be made by those skilled in the art without departing from the novel spirit and scope of this invention.

What is claimed is:

1. A process for producing shale oil, comprising the steps of:

(a) retorting a rubblized mass of oil shale of an underground retort to a sufficient temperature to produce shale oil, water, and off gases from said oil shale leaving retorted shale containing residual carbon by (1) combusting said residual carbon in said oil shale in a combustion zone behind a retorting zone in said underground retort with a flame front fed by a feed gas comprising air to produce combustion off gases comprising hydrogen, carbon dioxide, and substantial quantities of nitrogen, said flame front advancing generally in the direction of flow of said fed gas;

(2) purging said retort with a purging fluid selected from the group consisting essentially of steam, water, hydrogen, hydrogen-rich gases, and combinations thereof to quench said flame front while continuing to produce shale oil, water, and purge mode off gases from said retort, said purge mode off gases produced during said purging comprising hydrogen, carbon dioxide, and miminal quantities of nitrogen, said purge mode off gases having a substantially higher concentration of hydrogen and a substantially lower concentration of nitrogen than said combustion off gases produced during said combusting; and (3) subsequently reigniting said flame front;

(b) withdrawing said shale oil and water from said underground retort;

(c) substantially removing at least said carbon dioxide from said purge mode off gses;

(d) upgrading said shale oil with said purge mode off gases produced during said purging, in the absence of said combustion mode off gases, after said carbon dioxide has been removed from said purge mode off gases; and (e) said combustion off gases having an excessive amount of nitrogen and an insufficient amount of hydrogen for use in upgrading said shale oil.

2. A process in accordance with claim 1 wherein said purge mode off gases have at least five times as much hydrogen and less than one-fiftieth the amount of nitrogen as said combustion mode off gases.

3. A process in accordance with claim 1 wherein said purge mode off gases comprise by volume at least 45% hydrogen, less than 5% nitrogen, and greater than 40% carbon dioxide, and said combustion mode off gases comprise by volume less than 10% hydrogen, at least 50% nitrogen, and greater than 30% carbon dioxide.

4. A process in accordance with claim 1 wherein said feed gas further comprises a flame-front controlling fluid selected from the group consisting essentially of steam, water, recycled off gases, reactor off gases, and combinations thereof and said purging fluid comprises water.

5. A process for producing syncrude, comprising the steps of:

heating portions of rubberized masses of oil shale in retorting zones of a set of underground retorts to a temperature ranging from 800° F. to 1200° F. to liberate shale oil, retort water, and off gases from said oil shale leaving retorted shale containing carbon residue by sequentially operating said set of retorts in a combustion mode by combusting said carbon residue in said retorted oil shale in combustion zones above said retorting zones in said set of underground retorts with flame fronts supported by a combustion-supporting feed gas containing from about 5% to substantially less than 90% by volume molecular oxygen and a diluent comprising at least one member selected from the group consisting of off gases, steam, and retort water, to liberate shale oil, water, and hydrogen-lean, combustion mode off gases;

sequentially operating said set of underground retorts in a purge mode by pulsing and extinguishing said flame fronts in said set of retorts at different intervals and phases relative to each other with purge fluids selected from the group consisting esentially of water, steam, purge mode off gases, reactor off gases, hydrogen, and combinations thereof, to liberate more shale oil, water, and hydrogen-rich, purge mode off gases;

igniting said flame fronts in said retorts between pulses of said purge fluids with said feed gas;

said hydrogen-rich, purge mode off gases having a substantially greater concentration of hydrogen than said hydrogen-lean, combustion mode off gases;

separating said hydrogen-rich, purge mode off gases from said hydrogen-lean, combustion mode off gases;

withdrawing said shale oil and retort water from said retort;

substantially removing carbon dioxide from said purge mode off gases; and thereafter upgrading said shale oil with said hydrogen-rich, purge mode off gases in the presence of a catalyst and in the absence of said hydrogen-lean, combustion mode off gases to produce said syncrude.

6. A process in accordance with claim 5 including varying the oxygen content of said feed gas and said removing comprises scrubbing said purge mode off gases of said carbon dioxide after said separating and before said upgrading.

7. A process in accordance with claim 6 wherein:

said purge fluid comprises steam;

said feed gas containing air comprising nitrogen and oxygen;

said hydrogen-rich, purge mode off gases comprise by volume about 48% hydrogen, about 1% nitrogen, and about 41.5% carbon dioxide; and said hydrogen-lean, combustion mode off gases comprise by volume about 7% hydrogen, about 55.4% nitrogen, and about 32% carbon dioxide.

8. A process in accordance with claim 5 wherein said purge fluid consists essentially of said hydrogen-rich nitrogen-lean, purge mode off gases.

9. A process in accordance with claim 5 wherein said upgrading occurs in at least one reactor selected from the group consisting of a fluid bed reactor, an ebullated bed reactor, and a fixed bed reactor, and said purge fluid comprises reactor off gases.

10. A process for producing shale oil, comprising the steps of:

(a) forming a series of generally upright modified in situ underground oil shale retorts in subterranean formations of raw oil shale by removing from 2% to 40% by volume of said oil shale from said formations leaving cavities therein, transporting said removed shale to a location above ground for surface retorting, and explosively rubblizing masses of said oil shale substantially surrounding said cavities to form said series of underground retorts;

(b) igniting a flame front generally across each of said retorts with a fuel gas;

(c) pyrolizing portions of said rubblized raw oil shale in a retorting zone in each of said underground retorts to liberate shale oil, off gases, and raw retort water from said raw oil shale leaving retorted shale containing residual carbon, said raw retort water containing oil shale particulates, shale oil, ammonia, and organic carbon;

(d) advancing said retorting zone generally downwardly in each of said underground retorts;

(e) combusting residual carbon on said retorted shale in a combustion zone above said retorting zone in each of said underground retorts with a flame front;

(f) alternately injecting a flame front-supporting feed fluid containing air comprising nitrogen and oxygen and a flame front-extinguishing purging fluid selected from the group consisting essentially of steam, substantially purified water, and raw retort water containing oil shale particulates, shale oil, ammonia, and organic carbon, into each of said combustion zones while continuing step (d), said flame front-supporting feed fluid supporting, igniting and propelling said flame front generally downwardly to liberate hydrogen-lean, nitrogen-rich, combustion mode off gases and to define a combustion mode of operation, said flame front-extinguishing purging fluid extinguishing said flame fronts and accelerating transfer of sensible heat from said combustion zone to said retorting zones to liberate hydrogen-rich, nitrogen-lean, purge mode off gases and to define a purge mode of operation, said hydrogen-rich, nitrogen-lean, purge mode off gases liberated during said purge mode having a substantially greater concentration of hydrogen and a substantially lesser concentration of nitrogen than said hydrogen-lean, nitrogen-rich, combustion mode off gases liberated during said combustion mode;

(g) alternating operating some of said underground retorts in a combustion mode while operating other of said underground retorts in a purge mode and vice versa;

(h) withdrawing, separating, and isolating said liberated shale oil, combustion mode off gases, pure mode off gases, and raw retort water from said series of underground retorts;

(i) removing a substantial portion of carbon dioxide from said purge mode off gases to produce hydrogen-enriched, purge mode, upgrading off gases containing at least 70% by weight hydrogen; and (j) contacting said shale oil with only said hydrogen-enriched, purge mode, upgrading off gases in at least one reactor selected from the group consisting of a hydrotreater and a hydrocracker in the presence of a catalyst under upgrading conditions, and in the absence of said hydrogen-lean, nitrogen-rich combustion mode off gases and other gases, to upgrade said shale oil.

11. A process in accordance with claim 10 wherein:

about 15% to about 25% of said raw oil shale is removed from said subterranean formations;

carbon dioxide is removed from said purge mode gases in a scubber; and said combustion zone is cooled with said purge fluid to a temperature greater than 650° F. and less than 800° F. before reignition.

12. A process in accordance with claim 10 wherein said purge fluid comprises raw retort water containing oil shale particulates, shale oil, ammonia, and organic carbon, and some of said withdrawn retort water in step (h) is injected into said retorts for use as said purge fluid in step (f).

13. A process in accordance with claim 10 wherein said upgrading conditions in said reactor comprise:

a total pressure ranging from 500 psia to 6000 psia;

a hydrogen partial pressure ranging from 500 psia to 3000 psia;

a flow rate of said hydrogen-enriched off gases ranging from 2500 SCFB to 10,000 SCFB;

a liquid hourly space volume from 0.2 to 4 volumes of shale oil per hour of catalyst; and said upgrading includes removing a substantial amount of nitrogen, oxygen, sulfur, and trace metals from said shale oil.

14. A process in accordance with claim 13 wherein said shale oil is contacted with said hydrogen-enriched, purge mode, upgrading off gases in a hydrotreater at a temperature ranging from about 700° F. to about 830° F., and said catalyst has at least one hydrogenating component selected from the group consisting of cobalt, molybdenum, nickel, phosphorus, and combinations thereof, on a support consisting essentially of alumina, silica, zeolite, molecular sieves, and combinations thereof.

15. A process in accordance with claim 10 wherein said upgrading includes contacting said shale oil with said hydrogen-enriched, purge mode, upgrading off gases in a hydrocracker at a temperature ranging from about 650° F. to about 820° F.

* * * * *

UNITED STATES PATENT OFFICE
CERTIFICATE OF CORRECTION

Patent No. 4,532,991 Dated August 6, 1985

Inventor(s) George R. Hoekstra and John M. Forgac

It is certified that error appears in the above-identified patent and that said Letters Patent are hereby corrected as shown below:

Front Page, Item 73 reads "Standard Oil Company (Indiana), Chicago, Ill. and should read --Standard Oil Company (Indiana), Chicago, Illinois and Gulf Oil Corporation, Pittsburgh, Pennsylvania.

| Patent Column | Line | |
|---|---|---|
| 6 | 16 | reads "miximum" and should read --maximum-- |
| 13 | 16 | reads "...of rubberized..." and should read --rubblized-- |

Signed and Sealed this

*Seventeenth* Day of *June 1986*

[SEAL]

*Attest:*

DONALD J. QUIGG

*Attesting Officer* *Commissioner of Patents and Trademarks*